US006296310B1

(12) United States Patent
Laudenslayer et al.

(10) Patent No.: US 6,296,310 B1
(45) Date of Patent: Oct. 2, 2001

(54) SHAMPOO CHAIR

(76) Inventors: Joseph G. Laudenslayer, 107 Fairway Dr.; Julia C. Burr, 90 Fortune St., both of Black Mountain, NC (US) 28711

( * ) Notice: Subject to any disclaimer, the term of this patent is extended or adjusted under 35 U.S.C. 154(b) by 0 days.

(21) Appl. No.: 09/535,347

(22) Filed: Mar. 24, 2000

(51) Int. Cl.[7] ..... A47C 1/06
(52) U.S. Cl. ..... 297/344.19
(58) Field of Search ..... 297/344.19, 344.16

(56) References Cited

U.S. PATENT DOCUMENTS

| | | | | |
|---|---|---|---|---|
| 579,785 | * | 3/1897 | Barton | 297/344.19 X |
| 625,425 | * | 5/1899 | Sonnex | 297/344.19 X |
| 1,999,848 | * | 4/1935 | Ries | 297/344.19 X |
| 2,609,862 | * | 9/1952 | Pratt | 297/344.19 |
| 3,150,898 | * | 9/1964 | Knudson | 297/344.19 X |
| 3,311,407 | * | 3/1967 | Horie | 297/344.19 X |
| 3,653,648 | * | 4/1972 | Marshall | 297/344.19 |
| 3,810,673 | * | 5/1974 | Shoji | 297/344.19 X |
| 3,880,465 | * | 4/1975 | Scheben | 297/344.19 |
| 4,168,099 | | 9/1979 | Jacobs et al. | 297/325 |
| 4,711,486 | | 12/1987 | Fujiyama | 297/71 |
| 4,918,767 | | 4/1990 | Benting | 4/517 |
| 5,511,759 | | 4/1996 | DeKraker et al. | 248/575 |
| 5,967,610 | | 10/1999 | Lin | 297/340 |

FOREIGN PATENT DOCUMENTS

| | | | | |
|---|---|---|---|---|
| 1027244 | * | 4/1966 | (GB) | 297/344.16 |

* cited by examiner

*Primary Examiner*—Jose V. Chen
*Assistant Examiner*—Rodney B. White
(74) *Attorney, Agent, or Firm*—Joseph T. Guy; Nexsen Pruet Jacobs & Pollard, LLC

(57) ABSTRACT

A shampoo chair which is suitable for safe use with people of various sizes. The shampoo chair comprises a base and a hydraulic cylinder attached to the base. A piston is received by the hydraulic cylinder; and an actuator which is integral to the hydraulic cylinder, causes the piston to raise and lower. A seat is attached to the piston and raises and lowers in concert with the piston. A mounting cylinder and back bracket are also attached to the base. A seat back is pivotally attached to the back bracket.

17 Claims, 3 Drawing Sheets

SHAMPOO CHAIR

BACKGROUND

The present invention is related to a chair for use in a hair salon. More specifically, the present invention is directed to a chair specifically adapted for use in shampooing the scalp and hair of a person seated in the chair.

Reclining chairs for use when shampooing a person are legion in number. Typically, they comprise a lift mechanism such that the chair can be raised, or lowered, and a chair back which is pivotally attached to the seat of the chair. The chair back allows the person seated in the chair to partially lay down so that their head is over a shampooing sink.

It is apparent to anyone skilled in the art that the current state of the art chairs are uncomfortable for the person seated therein. One reason for this discomfort is the fact that the seat and seat back move up, or down, as a unit. Therefore, a tall person is not supported adequately when the back of the chair is reclined since their upper torso and head extend beyond the seat back. They must be supported to insure that they do not strike their head or neck on the shampoo sink. A shorter person may not reach far enough above the seat back for their head to be over the shampoo sink. In this instance the person must slide upwards on the seat back when it is reclined at which point they are no longer seated. These problems are particularly relevant for elderly people who may lack the strength necessary to support their own upper torso and head when suspended over the back of a chair or may not have the strength to slide upwards on the chair back and maintain themselves in a precarious position.

It has been a long felt desire in the art to provide a shampoo chair which is comfortable and adaptable to people of various sizes and physical conditions Efforts to fulfill this desire are provided in the art but deficiencies still remain. U.S. Pat. No. 4,918,767 provides a chair which travels along a guide path. The mechanism reduces the room between the chair and sink and virtually eliminates the ability of the beautician to traverse between the chair and shampoo sink. The complex mechanism also increases the cost. The combination of high cost and restricted traverse have rendered this particular chair impractical in hair salons.

U.S. Pat. No. 4,711,486 provides pivoted frame members manipulated by an internal hydraulic cylinder. This design does not alleviate the primary deficiency described above.

SUMMARY

It is an object of the present invention to provide a shampoo chair which is comfortable and which can be used by people of different heights.

It is another object of the present invention to provide a shampoo chair which is easily adjustable and the base does not have to be moved during use.

It is a particular feature of the present invention that the inventive chair is safer since a tall person does not risk having to support an upper torso and head which is extended beyond the edge of the chair back.

Yet another particular advantage of the present invention is the fact that the seat can be raised and lowered without moving the back rest.

These and other advantages, as will be apparent, are provided in a shampoo chair comprising a base and a hydraulic cylinder attached to the base. A piston is received by the hydraulic cylinder; and an actuator, which is integral to the hydraulic cylinder, causes the piston to raise and lower. A seat is attached to the piston and raises and lowers in concert with the piston. A mounting cylinder and back bracket are also attached to the base. A seat back is pivotally attached to the back bracket.

A preferred embodiment of the present invention is provided in a shampoo chair comprising a base with a hydraulic cylinder attached to the base. A piston is received by the hydraulic cylinder and a foot actuator, which is integral to the hydraulic cylinder, is capable of causing the piston to rise. A seat is attached to the piston and rises with the piston. A mounting cylinder is attached to the base and the hydraulic cylinder is contained within the mounting cylinder. A back bracket is attached to the mounting cylinder and a seat back is pivotally attached to the back bracket.

Yet another preferred embodiment is provided in a shampoo chair comprising a base wherein the base comprising a table rotatably attached to the base. A hydraulic cylinder is attached to the table and a piston is by the hydraulic cylinder. An actuator, integral to the hydraulic cylinder, is capable of causing the piston to move up and down in a direction which is substantially parallel to the hydraulic cylinder. a seat is attached to the piston and moves in concert therewith. A mounting cylinder is also attached to the table. A back bracket is attached to the mounting cylinder and a seat back is pivotally attached to the back bracket.

DETAILED DESCRIPTION

The invention will be described in reference to the figures wherein similar elements are numbered accordingly.

Figure 1:
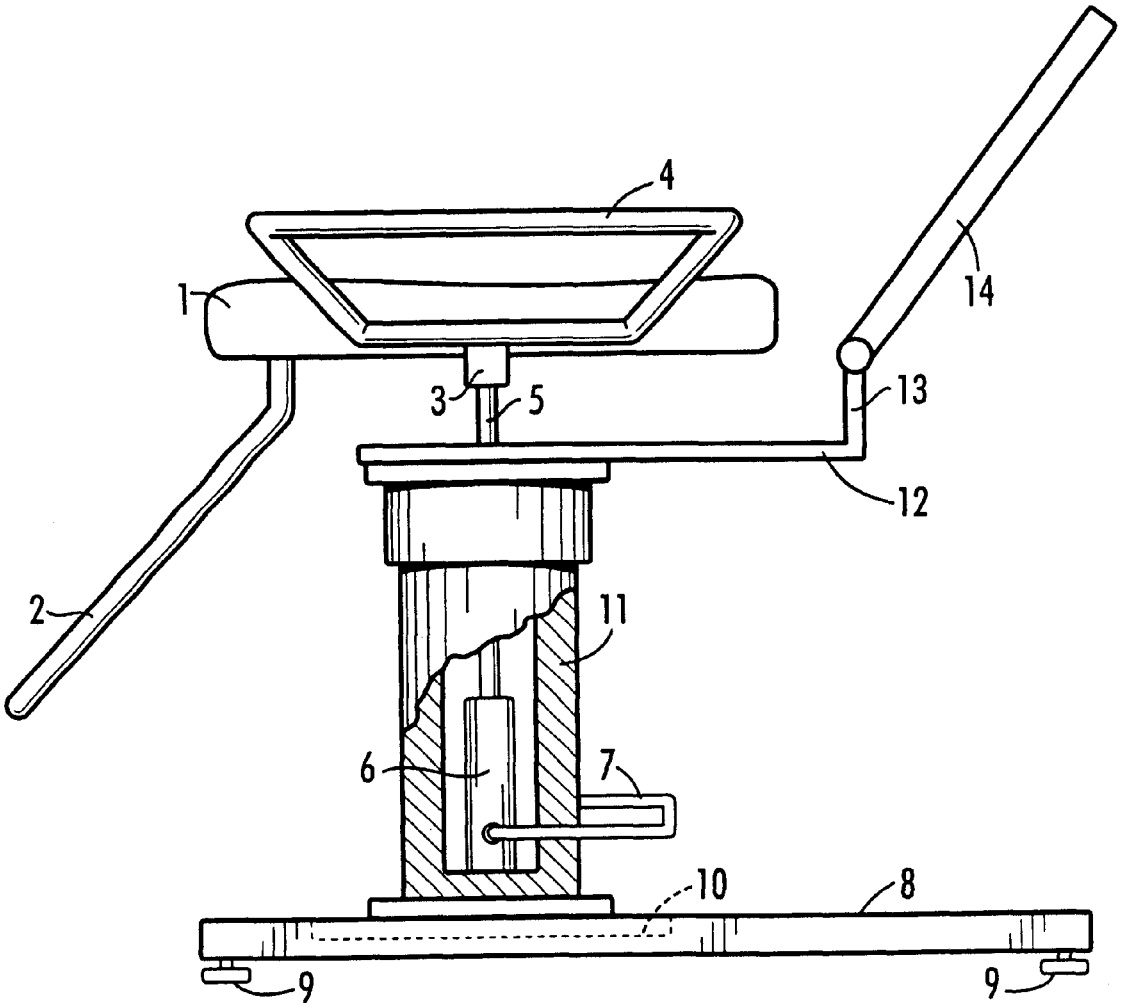
FIG. 1 is a side view of the present invention in partial cut-away view.

FIG. 1 is a side view of the present invention with a partial cutaway. In FIG. 1, the seat, 1, is preferably a cushioned seat as typical in the art. Attached to the seat, 1, is a footrest, 2, which can be a tubular member formed into the shape of a rectangle and secured to the bottom of the seat by any means known in the art. An armrest bracket, 3, is attached to the seat, preferably on the underside of the seat, by any means known in the art. The armrest bracket, 3, secures an armrest, 4, upon which the person in the chair can lay their arms in a comfortable position. Adjustable arm rest are contemplated as well known in the art. The seat, 1, is secured to a piston, 5, which is received within a hydraulic cylinder, 6. A foot actuator, 7, is attached to the hydraulic cylinder, 6. When the foot actuator is pumped the hydraulic fluid in the hydraulic cylinder forces the piston, 5, upward, perpendicular to the base, which raises and lowers the seat, 1, and attached footrest, 2, and armrest, 4. The seat is lowered by the foot actuator being held in a predetermined position which allows the weight of the seat to return the piston into the hydraulic cylinder and the seat is therefore lowered. The details of the hydraulic mechanism are well known and widely available and need not be described herein. A foot actuator, as illustrated, is preferable but other actuator mechanisms such as the type described in U.S. Pat. No. 4,918,767 are suitable for the purposes of demonstrating the present invention. The lower portion of the chair is formed by a base, 8, with optional adjusters, 9. The base is sufficiently large to insure that the chair is stable and can not be tipped over by a person sitting in the chair. The adjusters, 9, can be replaced by mounting brackets wherein the entire chair is secured to the floor. If the chair is secured to the floor the size of the base, 8, can be smaller as would be apparent to one skilled in the art. The base, 8, may comprise an optional rotating table, 10, rotatably mounted to the base to allow the entire chair to be rotated relative to the base. Attached to the base, 8, is a mounting cylinder, 11, which is shown in partial cutaway view. The mounting cylinder, 11, is attached to the base by any method known in the art. The hydraulic cylinder is preferably contained within the mounting cylinder. Attached to the upper extent of the mounting cylinder, 11, is a back bracket, 12. The back bracket may be attached to the mounting cylinder, 11, by any means known in the art. The back bracket preferably comprises a riser, 13. The back bracket and riser may be adjustable as would be apparent to one of ordinary skill in the art. Pivotally attached to the back bracket is a chair back, 14. The chair back can pivot to allow the person in the chair to sit upright or to lay back as would be necessary when using a conventional shampoo sink. It is a particular advantage of the present invention that the seat, 1, can be raised and lowered while the back rest remains static.

The present invention can be placed such that the back rest reclines to within a close proximity of the shampoo sink. The person sitting on the seat could then be raised or lowered such that their head is the proper distance above the chair back. When the chair back is lowered to the reclining position the persons head will be in the proper position relative to the shampoo sink without requiring the entire chair to be moved towards or away from the shampoo sink. Also, by raising or lowering the seat to the proper height prior to reclining the chair back the person in the chair is free from efforts normally required for proper positioning.

Figure 2:
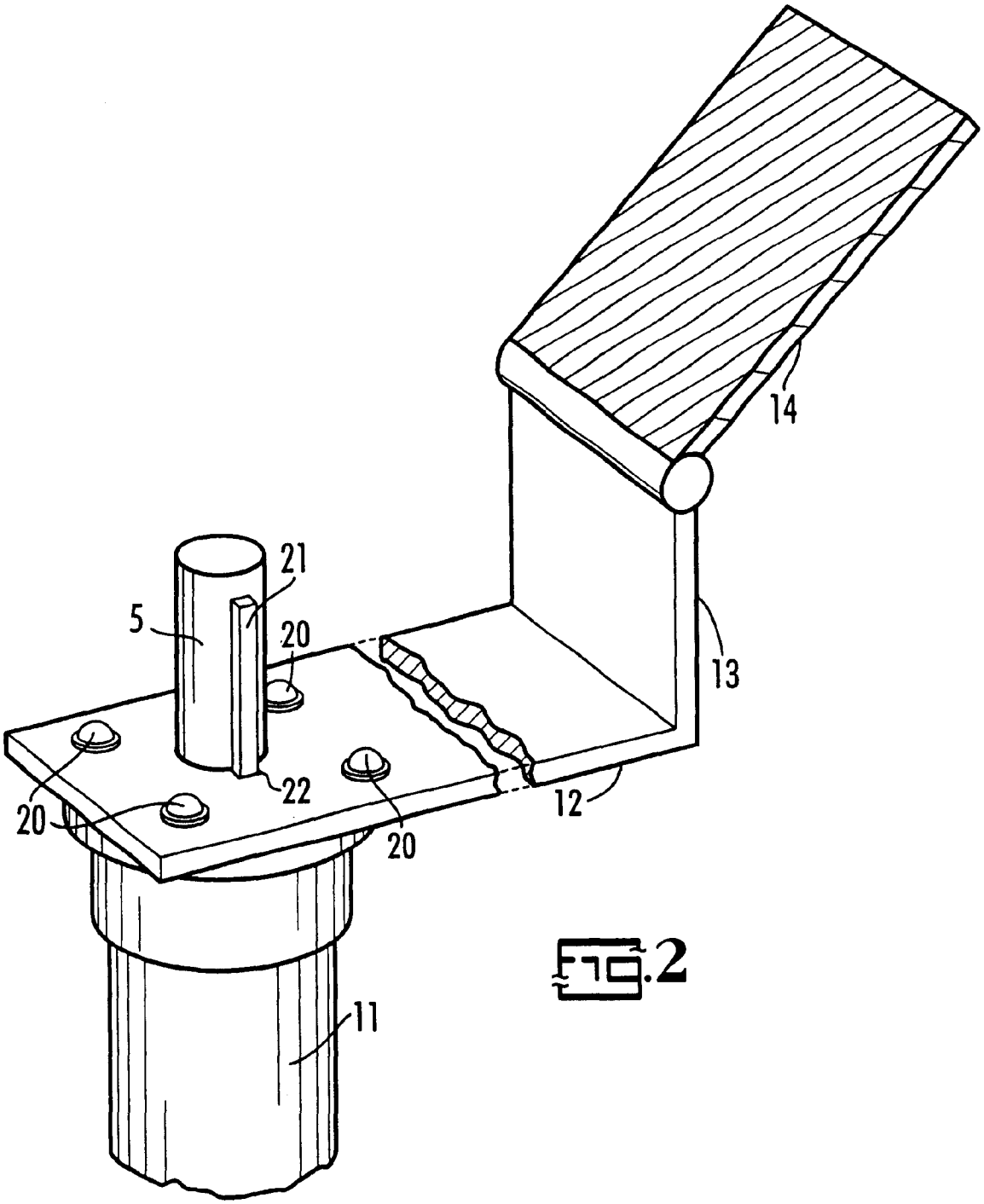
FIG. 2 is a partial drawing illustrating the back bracket and its relationship to the piston.

FIG. 2 provides a perspective partial view of the present invention. In FIG. 2, the piston, 5, is shown without a seat mounted thereon. The back bracket, 12, is attached to the mounting cylinder, 11, by bolts, 20, or other attachment means as known in the art. The seat back, 14, is shown pivotally attached to the riser, 13, of the back bracket, 12.

Figure 3:
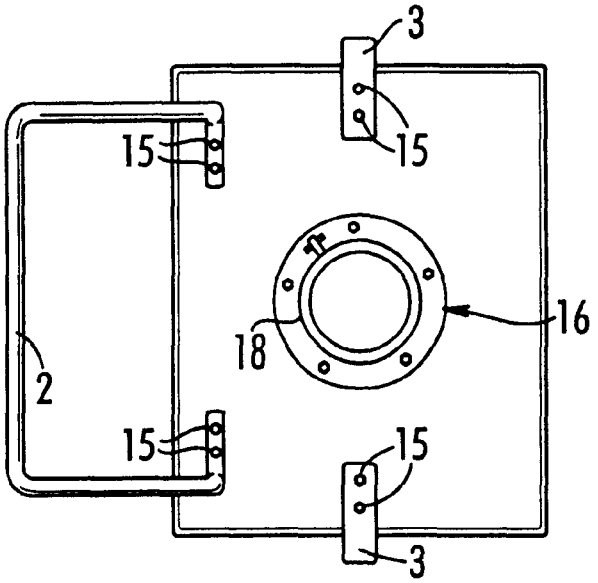
FIG. 3 is a bottom side view of the seat of the present invention.
Figure 4:
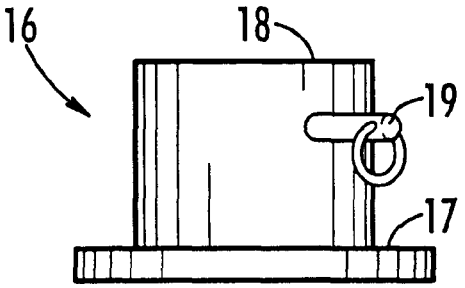
FIG. 4 is a side view of a preferred piston mounting bracket.

FIG. 3 provides a bottom view of the seat, 1. The armrest bracket, 3, and footrest, 2, are attached by screws, 15, or a similar attachment means as would be known in the art. In the center of the seat is a piston mounting bracket, 16. The piston mounting bracket is shown in side view in FIG. 4. The piston mounting bracket, 16, comprises a flange, 17, which mounts flush to the seat bottom. Secured to the flange, 17, is a cylinder, 18, which receives the piston. The piston mounting bracket is removably secured to the piston by a locking screw, 19, which engages with the surface of the piston to restrict movement of the piston mounting bracket relative to the piston.

The chair of the present invention can be assembled by any materials common to the art of shampoo chairs. Preferred are metals and metal alloys, plastics and composite materials as well as natural materials such as wood and the like. The materials can be attached by any means known in the art including threaded rods, such as screws, bolts with nuts, and the like; welding, gluing, tab and slot configurations, etc.

The apparatus described herein constitutes the preferred embodiments of the invention. It is understood that the invention is not limited to the form of apparatus as previously described and that changes can be made without departing from the scope of the invention.

What is claimed is:

1. A shampoo chair comprising:

a base;

a hydraulic cylinder attached to said base;

a piston received by said hydraulic cylinder; and an actuator integral to said hydraulic cylinder capable of causing said piston to raise and lower;

a seat attached to said piston; and a mounting cylinder attached to said base;

a back bracket attached to said mounting cylinder; and a seat back pivotally attached to said back bracket.

2. The shampoo chair of claim 1 wherein said hydraulic cylinder is contained within said mounting cylinder.

3. The shampoo chair of claim 1 further comprising a foot rest attached to said seat.

4. The shampoo chair of claim 1 further comprising at least one arm rest attached to said seat.

5. The shampoo chair of claim 1 wherein said actuator is a foot actuator.

6. The shampoo chair of claim 1 wherein said back bracket further comprises a riser.

7. The shampoo chair of claim 6 wherein said seat back is pivotally attached to said riser.

8. The shampoo chair of claim 1 wherein said base further comprises a table rotatably attached to said base.

9. The shampoo chair of claim 8 where in s aid hydraulic cylinder and said mounting cylinder are attached to said table.

10. A shampoo chair comprising:

a base;

a hydraulic cylinder attached to said base;

a piston received by said hydraulic cylinder capable of causing said piston to rise; and a seat attached to said piston; and a mounting cylinder attached to said base wherein said hydraulic cylinder is contained in said mounting cylinder;

a back bracket attached to said mounting cylinder; and a seat back pivotally attached to said back bracket.

11. The shampoo chair of claim 10 further comprising a foot rest attached to said seat.

12. The shampoo chair of claim 10 further comprising at least one arm rest attached to said seat.

13. The shampoo chair of claim 10 wherein said seat bracket further comprises a riser.

14. The shampoo chair of claim 13 wherein said seat back is pivotally attached to said riser.

15. The shampoo chair of claim 10 wherein said base further comprises a table rotatably attached to said base.

16. The shampoo chair of claim 15 wherein said hydraulic cylinder and said mounting cylinder are attached to said table.

17. A shampoo chair comprising:

a base comprising a table rotatably attached to said base;

a hydraulic cylinder attached to said table;

a piston received by said hydraulic cylinder;

an actuator integral to said hydraulic cylinder capable of causing said piston to move parallel to said hydraulic cylinder;

a seat attached to said piston;

a mounting cylinder attached to said table;

a back bracket attached to said mounting cylinder;

a seat back pivotally attached to said back bracket.

* * * * *